United States Patent [19]

Boldt et al.

[11] 4,313,386

[45] Feb. 2, 1982

[54] SYSTEM FOR TRANSPORT OF MIXTURES OF SOLID PARTICULATE FUEL AND AIR, AND ROTARY DISTRIBUTOR SUITABLE FOR USE THEREIN

[75] Inventors: Donald M. Boldt, Green Lane, Pa.; Elton McClellan, Harlem, GA

[73] Assignee: The Keller Corporation, Hatfield, Pa.

[21] Appl. No.: 90,100

[22] Filed: Nov. 1, 1979

[51] Int. Cl.[3] ..... F23K 3/02

[52] U.S. Cl. ..... 110/104 R; 110/104 B; 110/101 CF; 110/106; 110/263; 222/330

[58] Field of Search ..... 110/106, 104 R, 101 CF; 222/637, 330, 144, 144.5, 168; 406/122

[56] References Cited

U.S. PATENT DOCUMENTS

| | | | |
|---|---|---|---|
| 1,514,330 | 11/1924 | Neal et al. | 222/330 |
| 3,716,167 | 2/1973 | Huntington | 222/168 |
| 4,092,094 | 5/1978 | Lingl, Jr. | 110/104 R |
| 4,173,188 | 11/1979 | Pearce | 110/104 R |
| 4,182,245 | 1/1980 | Stewart et al. | 110/101 CF |
| 4,250,817 | 2/1981 | Michel | 110/106 |

*Primary Examiner*—Henry C. Yuen
*Attorney, Agent, or Firm*—Albert L. Free

[57] ABSTRACT

Fine particulate solid fuel particles are delivered from a venturi ejector to a rotating double-armed distributor which distributes fuel and air sequentially to conduits leading to the burner ejector of a kiln. The distributor is sealed and pressurized with air so as to provide the conduits with additional pulses of air following the times at which they receive fuel and air from the distributing operation.

6 Claims, 7 Drawing Figures

SYSTEM FOR TRANSPORT OF MIXTURES OF SOLID PARTICULATE FUEL AND AIR, AND ROTARY DISTRIBUTOR SUITABLE FOR USE THEREIN

BACKGROUND OF THE INVENTION

Especially in view of the increasing shortage of petroleum-based fuels and of natural gas fuels, the desirability has been recognized of being able to substitute for them other more available fuels such as particulate coal, sawdust, or other comminuted solid-fuel materials. However, different techniques are required for transporting and distributing the particulate fuel to the fuel burners, along with appropriate amounts of oxygen for accomplishing combustion, than are appropriate for oil and natural gas fuels, for example. A particular use for such particulate solid fuels is in the fueling of kiln furnaces used for the drying and/or firing of ceramic products such as bricks, for example, and it is with particular regard to such applications that the present invention will be described in detail.

It should be understood that in some applications, such as the kiln firing of bricks, it is desirable to supply the airborne particulate fuel from a single source to a plurality of burner ejectors, in controlled quantities and sequentially, so that the burner ejectors receive appropriate pulses of fuel at appropriately timed intervals, preferably together with enough primary air to effect the desired combustion of the particulate fuel in the furnace.

One form of apparatus which has been proposed for this purpose includes a rotary distributor of the airborne particulate fuel, wherein the airborne particulate fuel is supplied from a single source via an inlet conduit to the distributor, with the aid of a blade-type suction fan or blower in the line between the source and distributor inlet. The distributor in that case comprised a stationary plate within a distributor housing, having a series of spaced openings extending through the plate and arranged in a circle, the outlet conduits for supplying the several individual burner ejectors extending from these openings to the respective ejectors. Within the distributor housing, an eccentric rotating distributor arm was arranged to communicate from the distributor inlet to each of the plate openings in sequence, by rotating it into alignment with them successively as the arm rotated.

Such a system has been found to have several practical drawbacks. Firstly, because the conventional suction blower is positioned so as to be traversed by the airborne particulate fuel, it is constantly subject to impingement by these particles and hence tends to deteriorate rather rapidly. Although one might use a blower on the upstream side of the point of injection of the fuel as a means of avoiding impingement of the blower by the fuel particles, the resultant substantial back-pressures and outward air flows thereby produced at the fuel inlet present difficulties in injecting the particulate fuel into such an airstream.

Accordingly, we have found it desirable to use a venturi type arrangement for the fuel injecting operation, which in effect sucks the particulate fuel into a high-velocity air stream and, since it has no moving parts and presents a very small profile to the stream of fuel particles, does not deteriorate appreciably or require maintenance each over very long periods of use.

When such a venturi-type ejector is utilized, it preferably provides two basic functions, namely, it accomplishes injection and transportation of the desired amount of fuel, and in addition supplies primary air mixed with the fuel in an appropriate amount to facilitate proper combustion of the fuel at the burner ejectors. It will be understood that the operation of the venturi-type device is affected by the back pressure exerted by the entire air-fuel transportation system between it and the ultimate burner ejectors. Accordingly, if the venturi ejector is used with the previously-known system described above, it may be possible to provide a system which will operate satisfactorily in one specific application to supply a specific size at a particular rate, but it has not been found practical to design such a system which will provide operation over a wide range of fuels, fuel sizes, fuel delivery rates and burner ejector arrangements.

As a further drawback of the above-described previously-known system, the type of rotary distributor used was in itself found to be less than optimum for its intended purpose. First, it tended to introduce substantial undesired back pressures due to its feeding of outlet supply conduits and burner ejectors of restricted cross-sections one at a time. Secondly, leakage of particulate fuel into the housing of the rotary portion of the system tended to produce an accumulation of such particulate fuel therein, requiring rather frequent servicing and cleaning. While it had been recognized that such leakage was normally accompanied by a small elevated air pressure in the housing which might tend to drive some of the accumulated fuel particles into those outlet conduits not then being fed by the distributor, and thus to exert some degree of cleaning action, it has been found that this is not adequate to prevent rather rapid undesired accumulation of fuel particles in the housing. Also, the eccentric rotating arm described above was awkward to mount, resulted in an unbalanced rotational load, and was mechanically undesirable for these reasons.

Further, we have found it advantageous to be able to supply controlled amounts of additional air to the furnace, independently of that which is provided by the venturi ejector. For example, we have found it desirable in some cases thereby to supply a substantial excess of air to the furnace beyond the stoichiometric amount which would be theoretically required for complete combustion, so as to provide the desired atmosphere in the kiln furnace. The above-described previously-known system and distributor does not accomplish this, and the air which it supplies to the furnace is merely that which the venturi can provide as a part of its fuel-ejecting action.

Accordingly, it is an object of the present invention to provide a new and useful rotary distributor of airborne particulate solid fuel, having certain improved characteristics.

It is another object to provide such apparatus having improved self-cleaning characteristics.

Another object is to provide such a distributor which does not present an unbalanced rotational load.

Another object is to provide a system using a rotary distributor in combination with a venturi device for supplying air-borne particulate solid fuel through the distributor to burner ejectors, which system is efficient, has long life, does not require frequent maintenance, and can be adapted to a wide range of applications.

A further object is to provide such a system and distributor in which controlled amounts of air in addition to that provided by the venturi ejector can be delivered to the furnace in controlled amounts by way of the distributor.

SUMMARY OF THE INVENTION

These and other objects of the invention are achieved by the provision of a new and improved rotary distributor, and a new and improved system using same. The preferred form of the invention uses all of the following features, but at least some of the advantages thereof may be achieved by using less than all of them in systems designed for certain applications.

According to the preferred system of the invention, particulate solid fuel is injected into an air stream to form a stream of fuel and air in a supply conduit by means of a venturi ejector, thus avoiding the wear encountered when a down-stream blade-type blower is used. The stream of fuel and air thus formed is delivered by the supply conduit to a rotary distributor, which preferably employs a plurality of rotating conduit arms arranged to deliver the fuel-air stream to more than one burner-ejector supply conduit at a time, in a predetermined sequence, thus reducing the back-pressure arising when a single rotating conduit arm is used and thereby improving the efficiency and versatility of the system. The distributor also preferably includes an arrangement for supplying a pulse of substantially fuel-free air to the inlet end of each burner-ejector supply conduit shortly after that inlet end has been supplied with the fuel-air stream, thereby permitting controlled increase in the amount of air in the fuel-air stream delivered to the burner ejectors, and also providing a cleaning out of fuel tending to leak into the distributor housing.

The rotary distributor preferably comprises: a stationary bottom plate having a plurality of delivery outlet openings extending therethrough and arranged at different angular positions about a vertical axis, and each adapted to communicate with a different one of the burner-ejector supply conduits; a rotatable distributor assembly, rotatable about said axis and having an inlet opening on said axis for receiving the fuel and air stream from said supply conduit; a plurality of distributor conduit arms each communicating at its upper end with said inlet opening for receiving the fuel-air stream and dividing it among said arms; and a rotatable upper plate having a plurality of feed openings each extending therethrough and each positioned at the other end of one of said arms so as to receive the portion of said stream traversing its associated arm, said upper plate being positioned to rotate in closely-confronting relation to the upper side of said bottom plate; said feed openings being spaced from said axis at radii such as to become successively aligned with different ones of said outlet delivery openings in said bottom plate, and to feed the portions of each stream traversing each of said arms into said delivery openings as said rotatable distributor assembly is rotated.

Preferably said rotary distributor also comprises a housing enclosing said rotatable distributor assembly to seal it from the atmosphere, together with means for supplying the interior of said housing with pressurized air substantially free of fuel, and said upper plate is provided with one or more additional openings positioned so as to become aligned with different ones of said outlet delivery openings successively as said assembly is rotated, at which times the pressurized air in said housing produces a pulse of substantially fuel-free air through the corresponding outlet delivery opening.

In a preferred form, at least some of the additional openings in the upper plate extend to the periphery thereof, to aid in the cleaning-out of the housing by the pressurized-air pulses, as described hereinafter; preferably the rotatable distributor uses two rotatable conduit arms, positioned on directly opposite sides of said axis, to provide a balanced assembly.

In operation, the mixture of air and particulate solid fuel from the venturi ejector is carried to the inlet of the rotating distributor, passes through the distributor conduit arms, and is fed by the latter arms in sequence to various ones of the apertures in the underlying stationary plate and thence to the corresponding outlet conduits leading to the fuel utilization apparatus, such as furnace burner ejectors for example. A pressurized stream of air supplied to the distributor housing passes through the additional openings in the upper plate to successive ones of those outlet delivery openings exposed in the bottom plate which have just previously been supplied with the air-fuel mixture, thus providing the desired subsequent pulses of fuel-free air into each burner-ejector conduit. Because, in the preferred embodiment, there is more than one distributing conduit arm, the effective cross-section for flow of the air-fuel mixture through the system is increased, resulting in less back pressure to the venturi ejector then would be the case for a single rotating distributor arm conduit, and enabling more effective design and operation of the venturi ejector and greater effectiveness in supplying the necessary amount of fuel and air to the distributor. In addition, the use of more than one distributor conduit arm enables a symmetrical arrangement thereof about the center of rotation, thereby providing a mechanically balanced rotating structure with resultant mechanical benefits. Importantly, the system can be adjusted to operate properly and reliably under a wide range of variations in operating parameters of fuel type, fuel supply rate, primary air, burner conduit lengths, etc., by adjustment of the air flow into the distributor housing.

BRIEF DESCRIPTION OF FIGURES

These and other objects and features of the invention will be more readily understood from the following detailed description taken with the accompanying drawings, in which.

DETAILED DESCRIPTION OF SPECIFIC EMBODIMENTS

Figure 1:
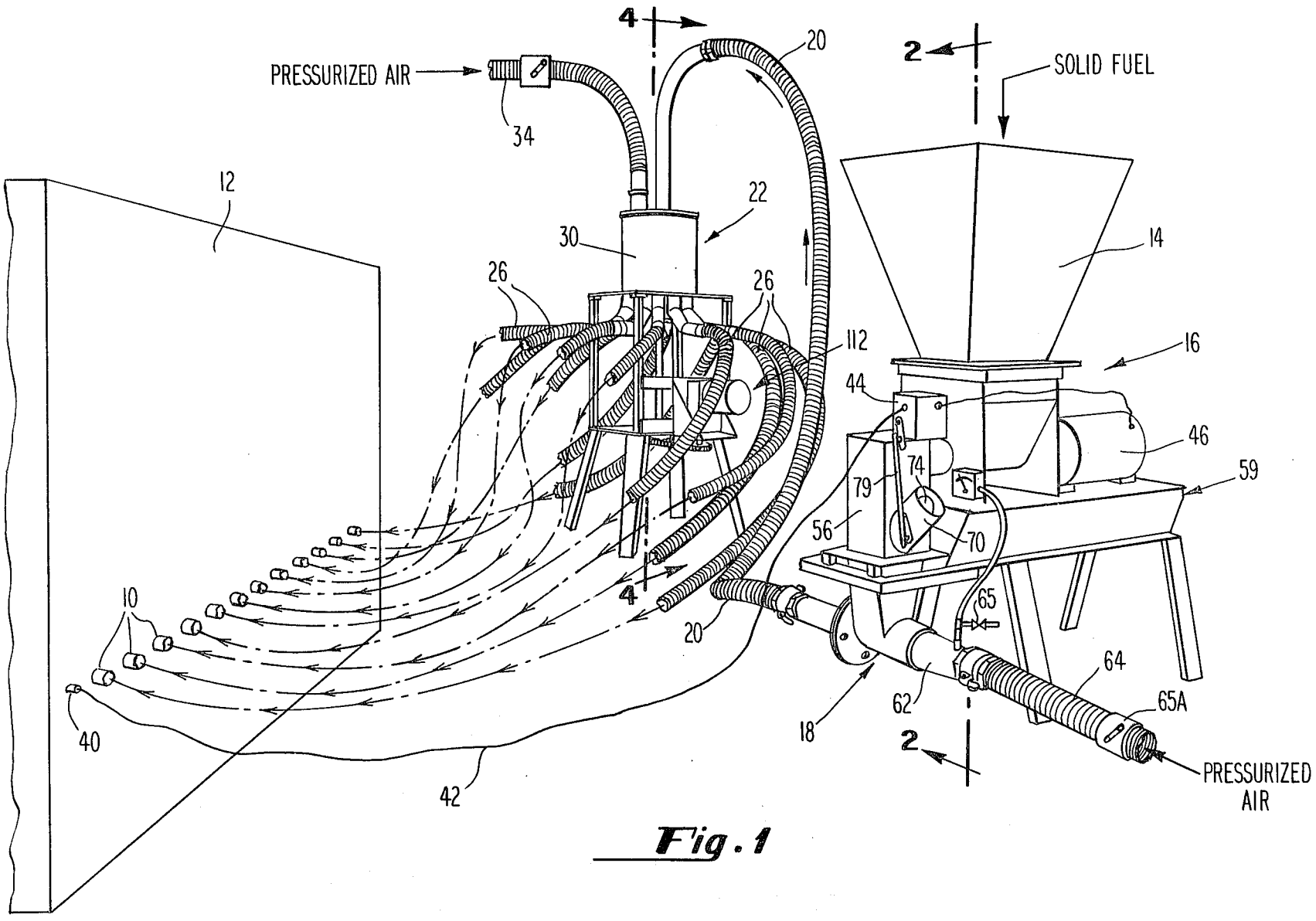
FIG. 1 is a perspective view illustrating one application of the system of the invention.

Turning now to a detailed description of a representative embodiment of the invention by way of example only, FIG. 1 shows such system as applied to the supplying of pulses of an appropriate fuel and air mixture to a plurality of burner ejectors such as 10, extending through a wall 12 of a brick-producing kiln disposed on the opposite side of wall 12. In this example there are twelve such burner-ejectors disposed in a line along the sidewall; in other applications the burner heads may be at various other positions on the sidewall, and/or on the top crown of the kiln, and there may be different numbers of them than shown, as is well known in the art.

A particulate solid fuel is continuously or repetitively dumped in any conventional manner into a receiving hopper 14, to provide the fuel input for the system. While the system will accommodate a wide range of types and sizes of fuel particles, in this example it will be assumed that the fuel is coal, made up of particles most of which are near 1/32" in diameter, and nearly all of which are between 1/64" and 3/16" in diameter.

As will be described in more detail hereinafter, the fuel particles are delivered by an adjustable fuel feeding arrangement 16 to a venturi ejector 18, which produces a negative pressure in the fuel feeding arrangement to suck the fuel particles into the venturi, and delivers them, along with air, through a supply conduit 20 to a rotary distributor 22. During its rotation, the distributor 22 feeds the fuel-air mixture from supply conduit 20 successively into different pairs of the burner-ejector supply conduits such as 26, in a predetermined sequence. It will be understood that in FIG. 1, while the inlet portions of the conduits 26 are shown in full perspective, in the interest of clarity the remaining portions of these conduits are represented by broken single lines leading to their corresponding burner ejectors 10. For reasons described in detail hereinafter, distributor 22 includes an outer housing for sealing the internal distributor parts from atmosphere, and the interior of this housing is supplied with pressurized air by way of an air-supply conduit 34.

It will be understood that depending upon the particular combustion conditions desired in the firing zone of the kiln, the pairs of burner-ejector conduits 26 which are simultaneously supplied with pulses of fuel and air by the distributor 22 may be connected to any suitable corresponding pair of burner ejectors, and this invention is not concerned with which burner ejectors are connected to which burner-ejector supply conduits in a given application of the invention.

In a complete system, there will usually be sensing devices such as 40 extending into the furnace of the kiln, and connected back, as by electrical cable 42, to a control box 44 at the fuel feeding arrangement 16, to control the fuel and air feed in accordance with sensed conditions within the furnace. The sensors 40 are usually temperature sensors, and it will be understood that they may be present in substantial numbers at various positions in the furnace, although for convenience only one such sensor is shown in the drawing of FIG. 1.

Figure 2:
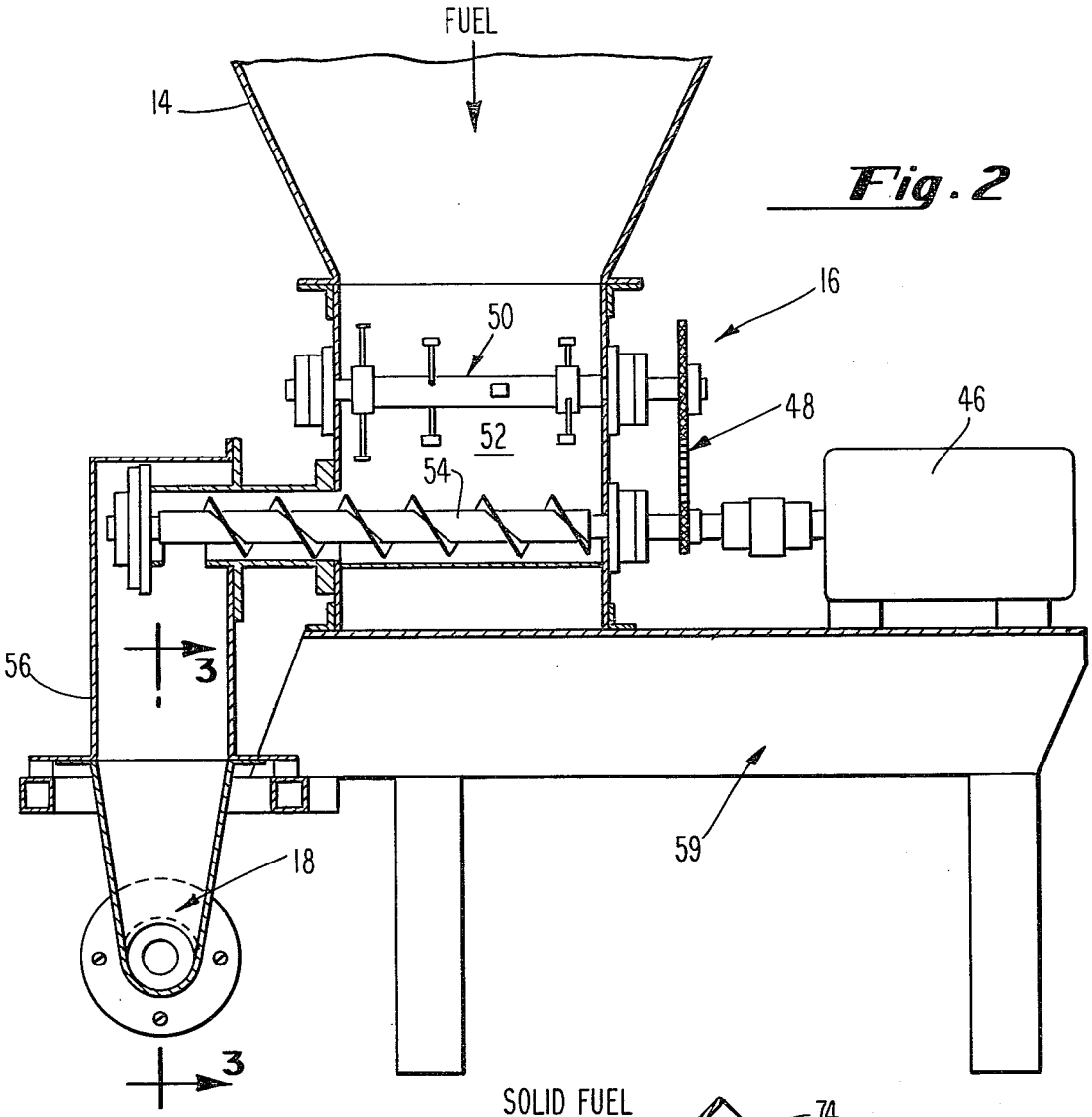
FIG. 2 is a view taken along lines 2—2 of FIG. 1, showing the fuel feeding arrangement.

Referring now especially to FIG. 2 for further details of the fuel-feeding arrangement 16, a controlledly-variable speed motor 46 acts through a sprocket and chain arrangement 48 to drive a rotary mixer 50 located in the path of fuel descending by gravity from hopper 14, to assure that proper feeding of the fuel is maintained at all rates of feed. The fuel passing mixer 50 falls into an auger chamber 52 containing a feed auger 54 which is driven in rotation by motor 46 at selected appropriate speeds. The auger 54 moves the solid fuel forwardly into the top of a drop chamber 56, wherein it drops into the venturi-ejector arrangement 18 located beneath it. By varying the speed of motor 46 the rate of supply of fuel to the drop chamber can be controlled as desired. In one typical embodiment, the rate of feed of coal particles may be adjusted to anywhere between about 30 and 300 pounds per hour. The fuel feed arrangement and the venturi ejector arrangement may be supported, if desired, upon a suitable table 59.

Figure 3:
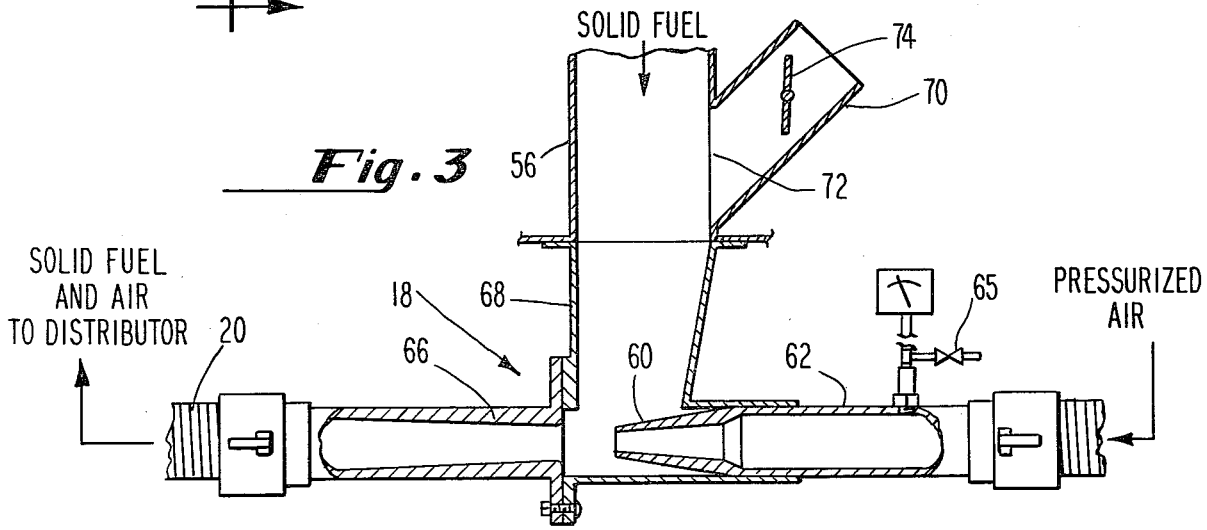
FIG. 3 is a vertical sectional view of the venturi ejector of FIG. 1.

Referring now to FIG. 3 with regard to details of the venturi ejector arrangement, this includes means in the form of a nozzle 60 for forming a jet of air in response to a flow of pressurized air supplied to the opposite end of nozzle-supply conduit 62. The pressurized air source may be any commercial device suitable for such purposes, connected to conduit 62 by an appropriate flexible conduit 64. An appropriate air cock 65 may be provided to show the pressure in conduit 62, to facilitate adjustment thereof to a suitable operating value by means of butterfly valve 65*a* (FIG. 1). Spaced in front of and near the outlet end of nozzle 60 is a venturi 66, shaped in known manner so that the jet of pressurized air supplied to the center of the venturi from nozzle 60 will produce a negative pressure in the drop chamber 56 above the venturi arrangement, thereby sucking in fuel particles from chamber 56 and positively transporting them through venturi 66 into the flexible supply conduit 20 for delivery to the rotary distributor. In the typical application now being described, the linear velocity of air from nozzle 60 may be approximately 21,000 ft. per minute, and the volume of air moving in conduit 20 may be about 190 cubic feet per minute.

FIG. 13 also shows an air bypass conduit stub 70 connecting a bypass opening 72 in the sidewall of drop chamber 56 to atmosphere. Conduit stub 70 contains a rotatable butterfly valve 74, which can be rotated to a fully-closed position normal to the axis of conduit stub 70 and to a fully-open position parallel to that axis. The farther open is butterfly valve 74, the greater is the amount of bypass air entering conduit 70 from the atmosphere and reaching the space between the venturi nozzle and the venturi, resulting in a reduced suction effect on the fuel particles in drop chamber 56. In the present example, complete closing of the butterfly valve may result in air flow of about 190 cubic feet per minute in supply conduit 20; when butterfly valve is fully opened, the venturi ejector 18 draws additional air from the atmosphere, bypassing the fuel feeding arrangement 16. Typically, negative pressures of about $1\frac{1}{2}$ to 3 inches of water column are produced in chamber 56 during a normal operation. In such normal operation, control box 44, operating through lever arm 79 of FIG. 1 automatically operates butterfly valve 74 to the desired position in response to electrical signals supplied thereto from temperature sensors such as 40 by way of cable 42.

In one representative embodiment of the invention, the pressurized-air pressure was about 20 ounces per square inch, the inner diameter of nozzle 60 was about $1\frac{1}{8}$ inches, and venturi 66 was about $13\frac{1}{2}$ inches long with a minimum inside diameter or throat of about $1\frac{1}{2}$ inches and a maximum diameter of about $2\frac{1}{2}$ inches, to feed a supply conduit 20 of about $2\frac{1}{2}$ inches inner diameter.

Figure 6:
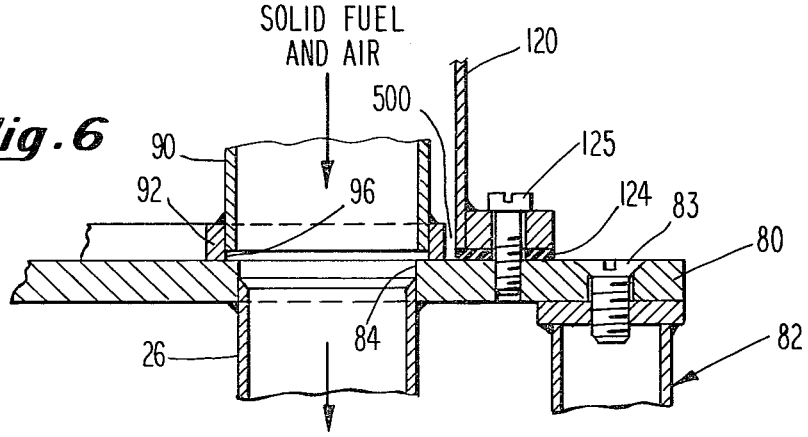
FIG. 6 is an enlarged fragmentary view, in vertical section, of the portion of the distributor at 6 of FIG. 4.

Turning now to the rotary distributor arrangement shown in the remaining FIGS. 4–7, the distributor system includes a flat, stationary, bottom plate 80, which is centrally apertured and mounted in a horizontal position on an appropriate stand 82 by screws such as 83. As is seen most clearly in FIGS. 5 and 6, bottom plate 80 is provided in this example with 12 outlet delivery openings such as 84, one for each of the flexible burner-ejector supply conduits such as 26; as shown in FIG. 6, the inlet end of each such burner-ejector supply conduit is preferably provided with beveled leading edges, and is inserted partially into its corresponding opening 84 and welded into that position.

Positioned above bottom plate 80 is a rotating assembly including a distributor inlet conduit 86, which communicates at its lower end with a pair of descending distributor conduit arms 88 and 90, the lower ends of which conduit arms extend into, and are secured to, a centrally-apertured rotatable upper plate 92. To accomplish this, upper plate 92 is provided with feed openings 94 and 96 extending vertically therethrough for receiving the lower ends of the conduit arms 88 and 90 respectively, in which they are secured as by welding. The rotating assembly of upper plate 92 and conduit arm 86, 88 and 90 is supported at 98 on an upper rotatable shaft 100 secured to lower rotating shaft 102 by an appropriate flanged coupling 104. Lower shaft 102 is, in turn, supported on the underside of plate 80 by a suitable upper bearing 106, which also covers and seals the central aperture in plate 80, and on a floor 108 of stand 82 by means of a lower bearing 110. Shaft 102 is driven at a controllable speed by the motor arrangement 112 by way of sprockets 114 and 116 and interconnecting drive chain 118.

The rotating assembly in the distributor is enclosed and sealed against atmospheric by a distributor housing 120, secured to the top of bottom plate 80 by a peripheral flange 122, an appropriate sealing gasket 124 beneath the flange, and appropriate screws 125.

In order to supply the fuel and air stream from the supply conduit 20 to inlet conduit 86, the top of housing 120 is provided with flanged sleeve 130 extending therethrough, with the supply end of supply conduit 20 fitting into the top of sleeve 130 and the upper end of rotating inlet conduit 86 fitting into the lower end of sleeve 130. A recessed resilient O-ring gasket 135 is provided in the interior wall of sleeve 130 adjacent inlet conduit 86 to permit the latter inlet conduit to rotate within sleeve 130 while maintaining its seal against atmosphere.

Figure 4:
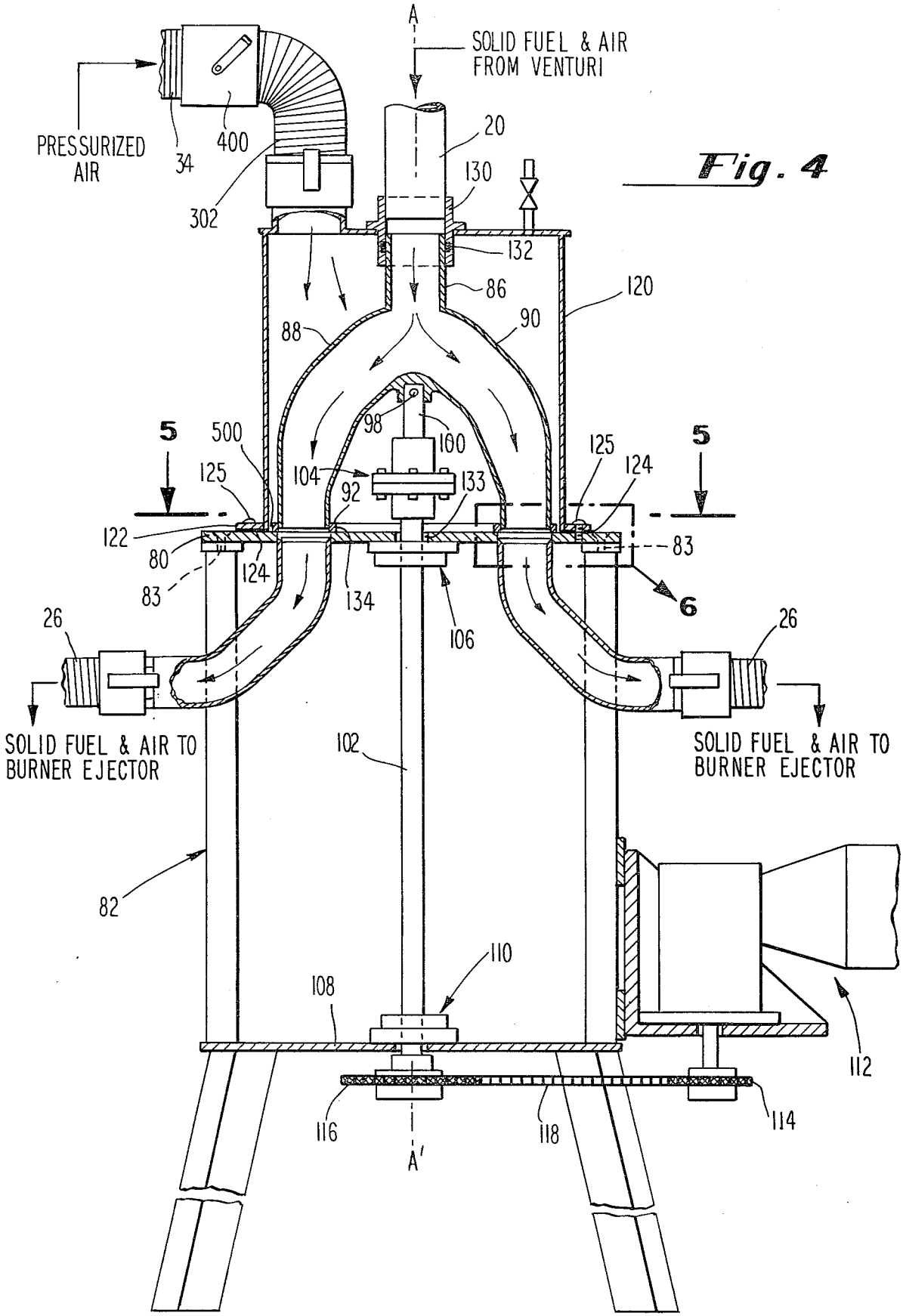
FIG. 4 is a vertical sectional view of the distributor, taken along lines 4—4 of FIG. 1.
Figure 5:
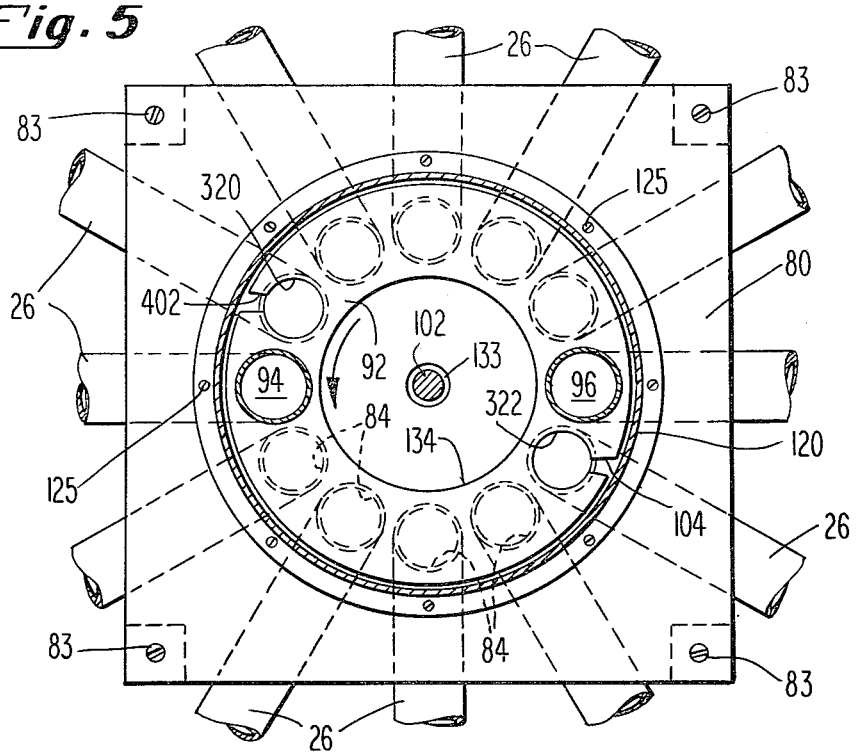
FIG. 5 is a horizontal sectional view of the distributor, taken along lines 5—5 of FIG. 4.

As shown in FIG. 4, lower rotating shaft 102, upper rotating shaft 100, and the rotating assembly of the inlet conduit 86, distributor conduit arms 88 and 90, and top plate 92, are all mounted for rotation about a common vertical axis A A', and the central apertures 133 and 134 in the bottom and upper plates 80 and 92 are also concentric about this axis. Furthermore, the centers of the outlet delivery apertures such as 84 in the bottom plate and the centers of the feed openings 94 and 96 in the top or upper plate, are all at the same radius from axis A A'. Also, in this example, the two distributor conduit arms 88 and 90 lie on directly opposite sides of the axis A A', and the outlet delivery openings such as 84 in the bottom plate are equi-angularly spaced from each other about axis A A'.

Accordingly, upon the operation of motor 112, the rotating assembly of the distributor rotates in such manner that the feed openings 94 and 96 in the upper plate 92 pass successively into alignment with different diametrically-opposite pairs of delivery outlet openings 84, so as to feed the fuel-air stream from conduit 20 successively into different pairs of the burner-ejector supply conduits such as 26.

In addition, distributor housing 120 is provided with a pressurized-air inlet opening 300 in its top surface, through which pressurized air, substantially free of fuel and normally entirely free of fuel, is supplied by way of pressurized-air conduit 302 from an air source which may be the same pressurized air source as is used to supply the venturi nozzle. Further, as shown particularly clearly in FIGS. 5 and 7, upper plate 92 is provided with a pair of additional openings 320 and 322 extending vertically therethrough, which additional openings are positioned at the same radial distance from axis A A' as are the feed openings 94 and 96 and the outlet delivery openings such as 84. Additional openings 320 and 322 are circumferentially positioned slightly behind each of the feed openings 94 and 96, respectively, with respect to the counterclockwise direction of rotation of the upper plate indicated in FIG. 7. In this embodiment, the centers of additional openings 320 and 322 are spaced from the centers of feed openings 94 and 96 by the same circumferential distance as separates the centers of the outlet delivery openings 84 from each other in the bottom plate.

Accordingly, when upper plate 92 has been rotated to reach a position in which feed openings 94 and 96 are directly aligned with a corresponding diametrically-opposed pair of outlet delivery openings 84, at the same time additional apertures 320 and 322 are aligned with those outlet delivery openings 84 which were last-previously supplied with fuel and air from the conduit arms 88 and 90. Due to the positive air pressure maintained in housing 120 as described above, this causes an additional pulse of substantially fuel-free air through each of the additional openings 320 and 322 into the inlet ends of the corresponding ones of the burner-ejector supply conduits 26, thus moving the previously supplied fuel and air mixture further along these burner-ejector supply conduits, and providing the corresponding burner-ejectors with a controlled additional amount of air, and also clearing the interior of the housing 120 of fuel which may have inadvertently leaked into it from the rotating assembly. It is noted that conduit 302 for supplying pressurized air to the interior of housing 120 includes a butterfly valve 400, which can be rotatably adjusted to control the amount of air in the additional pulses of air thus supplied successively to the pairs of burner-ejector supply conduits, so as to provide any of a wide range of amounts of additional air at the outlets of the burner ejectors or to maintain any given desired amount of air at the outlets of the burner ejectors under different operating conditions of the system.

In one example, the inner diameters of the distributor conduit arms was two inches, the ID of the burner-ejector supply conduits was about two inches, and the ID of the burner ejectors about two inches, while the rate of rotation of the distributor was about 3 revolutions per minute.

Figure 7:
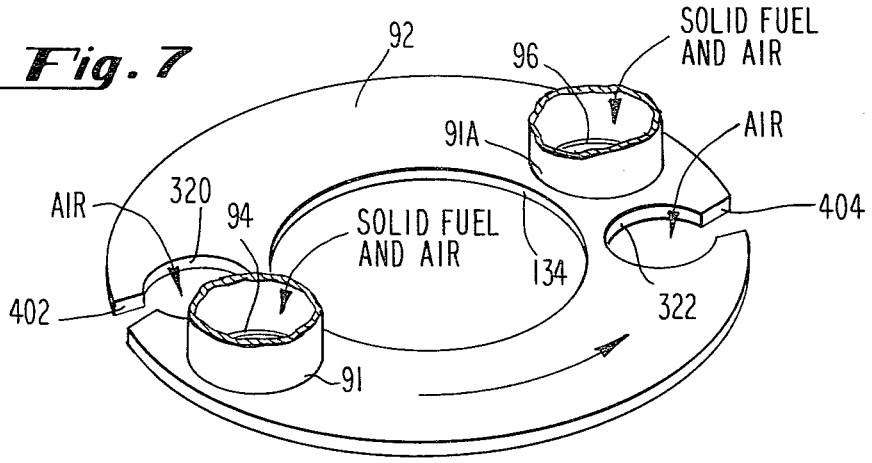
FIG. 7 is a perspective view of the rotating upper plate of the distributor.

It is further noted that in the preferred form of the invention shown in the drawings, and especially clearly in FIG. 7, the additional apertures 320 and 322 extend to the adjacent respective edges of the upper plate 92 at 402 and 404 respectively, with the following advantage. It will be noted especially in FIG. 4 that there is a relatively narrow space 500 on the top of the bottom plate 80 between the periphery of the upper plate 92 and the interior of housing 120, in which any fuel particles leaked from the distributor conduit arms might tend to accumulate, adversely affecting operation and requiring frequent mainteance. However, since additional opening 320 and 322 extend to the periphery of upper plate 92, space 500 will be constantly scanned by openings 320 and 322 which provide an easy path for any fuel thus tending to collect in space 500 to be driven into the outlet delivery openings in the bottom plate in response to the positive pressure maintained in the housing, during the additional pulses of air flow produced by such interior positive pressure. Undesired accumulation of fuel particles in the region 500 is thereby greatly reduced.

It will be understood that the upper plate 92 and the bottom plate 80 are so mounted relative to each other as to be in closely confronting relationship to each other, and preferably are mounted as closely as is possible without producing undesirable abrasion or binding of their confronting surfaces against each other. Thus the top plate 92 is effective to seal off all of the outlet delivery openings in the bottom plate which are covered by the upper plate at any time, limiting communication to those times at which an outlet delivery opening in the bottom plate is overlapped by either one of the feed openings 94 or 96 or one of the additional openings 320 and 322. Thus only a very small amount of a fuel is likely to leak into the interior of housing 120 in any event.

It will further be understood that various control and safety features will ordinarily be built into the system, such as arrangements for automatically cutting off the fuel feed if the air pressures at the venturi ejector are not within proper ranges, and for shutting down the system if the distributor does not complete a revolution in a prescribed time; however, the invention is not concerned with details of such arrangements and accordingly they have not been shown.

It will be understood also that while a pair of distributor conduit arms are shown in the representative embodiment of the invention, a greater number of conduit arms may be used in some cases, preferably in a balanced or symmetrical arrangement about the central axis, to provide fuel and air to more than two burner-ejector supply conduits at a time, and that the use of a plurality of rotating conduit arms instead of a single arm in itself provides appreciable advantage over previous systems, particularly in that the back-pressure resistance of the burner-ejector supply lines is reduced by a factor proportional to the number of rotating conduit arms used; this advantage exists even if the upper plate arrangement and the arrangement for pressurizing the housing are not employed. Similarly, the distributor is useful and advantageous in some cases even if the fuel ejector is not of the venturi type. However, the entire system utilizing the pair of distributor conduit arms, the upper plate, the additional apertures, the pressurized housing and the venturi ejector, cooperates to produce an especially effective arrangement adaptable to a wide range of applications and a wide range of system operating parameters.

Accordingly, while the invention has been described with particular reference to specific embodiments thereof in the interest of complete definiteness, it may be embodied in a wide variety of forms diverse from those specifically shown and described without departing from the spirit and scope of the invention as defined by the appended claims.

What is claimed is:

1. Distributor apparatus for delivering a stream of particulate solid fuel particles and air from a single stationary source thereof to a plurality of burner-ejector supply conduits in sequence, comprising:

a stationary bottom plate having a plurality of outlet delivery openings extending therethrough, said openings being disposed at different angular positions about a vertical axis through said stationary plate and each being adapted to communicate with the inlet end of a different one of said burner-ejector supply conduits;

a rotatable distributor assembly mounted for rotation above said bottom plate and about said axis;

said rotatable distributor assembly comprising distributor inlet means having an inlet opening through which said axis extends for receiving said stream of solid fuel particles and air from said source, at least two distributor conduit arms each communicating at one of its ends with said distributor inlet means for receiving said stream and dividing it among said arms, and a rotatable upper plate having a plurality of feed openings each extending therethrough and each positioned at the other end of one of said arms so as to receive the portion of said stream traversing its associated arm, said upper plate being positioned to rotate in closely-confronting relation to the upper side of said bottom plate;

said feed openings being spaced from said axis at radii such as to become successively aligned with different ones of said outlet delivery openings in said bottom plate, and to feed the portions of said stream traversing said arms into said different delivery openings as said rotatable distributor assembly is rotated about said axis; a housing enclosing said rotatable distributor assembly to seal it from the ambient atmosphere; pressurized air inlet means for said housing; and means for pressurizing the interior of said housing with air by way of said air inlet means.

2. In a system for delivering a stream of particulate fuel and air from a source of said fuel to a plurality of burner-ejectors in sequence, comprising:

venturi ejector means, comprising means for forming a stream of air and a venturi for receiving said stream of air;

means for delivering said particulate fuel to the region between said stream-forming means and said venturi to produce a stream of mixed fuel and air from said venturi ejector means;

distributor apparatus having inlet means and outlet delivery openings;

supply conduit means for supplying said stream of fuel and air from said venturi ejector means to said inlet means;

burner-ejector supply conduits having their inlet ends communicating with said outlet delivery openings;

said distributor apparatus being operative to cause said inlet means to communicate successively with various of said outlet delivery openings;

the improvement wherein said distributor apparatus comprises a plurality of distributor conduit arms each communicating with said inlet means so as to be supplied with said stream of fuel and air, said conduit arms being rotatable to communicate successively and repetitively with different ones of said outlet delivery openings to supply a mixture of said fuel and air for delivery to said burner ejectors, and means for delivering a pulse of substantially fuel-free air to each of said outlet delivery openings between those times at which it is supplied with said mixture of fuel and air by said distributor conduit arms.

3. The system of claim 2, wherein said means for delivering a pulse comprises: a housing substantially sealing said outlet delivery openings from atmosphere; means for providing the interior of said housing with a positive air pressure; and means for successively exposing each of said outlet delivery openings to said positive air pressure for a limited time after each successive communication thereof with one of said distributor conduit means, and for shielding said outlet delivery openings from said positive air pressure in said housing at other times.

4. The system of claim 2, wherein said means for successively exposing said outlet delivery openings comprises an apertured plate rotating with said distributor conduit arms, each of said bottom ends of said distributor conduit arms being sealed to said rotating plate, said rotating plate having feed openings extending therethrough aligned with said bottom ends of said distributor conduit arms and having additional openings therethrough each immediately behind a different one of said feed openings relative to the direction of rotation to said apertured plate.

5. In a system for delivering a stream of particulate fuel and air from a source of said fuel to a plurality of burner ejectors in sequence, comprising:

venturi ejector means, comprising means for forming a stream of air and a venturi for receiving said stream of air;

means for delivering said particulate fuel to the region between said stream-forming means and said venturi to produce a stream of mixed fuel and air from said venturi ejector means;

distributor apparatus having inlet means and outlet delivery openings;

supply conduit means for supplying said stream of fuel and air from said venturi ejector means to said inlet means;

burner-ejector supply conduits having their inlet ends communicating with said outlet delivery openings;

said distributor apparatus being operative to cause said inlet means to communicate successively with various of said outlet delivery openings;

the improvement comprising auxiliary air-flow producing means to supply each of said outlet delivery openings with a pulse of air substantially free of fuel, during limited time intervals between those time intervals in which said inlet means communicates with said each outlet delivery opening, and wherein said auxiliary air-flow producing means comprise a housing sealing said outlet delivery openings from the surrounding atmosphere, means for providing in said housing pressurized air substantially free of fuel and at a positive pressure, and means for exposing each of said outlet delivery openings to said air substantially free of fuel only during said limited time intervals.

6. The system of claim 5, wherein said means for exposing each of said delivery openings comprises a stationary bottom plate through which said outlet delivery openings extend, an upper plate closely confronting said lower stationary plate having feed openings therethrough for delivering said fuel and air stream to said outlet delivery openings from said distributor inlet means and having other openings for exposing said outlet delivery openings to said air substantially free of fuel, said upper plate being rotatable to expose said outlet delivery openings respectively and successively first to said fuel and air stream and then to said pressurized air substantially free of fuel.

* * * * *